United States Patent [19]

Shazeer

[11] Patent Number: 4,496,154

[45] Date of Patent: Jan. 29, 1985

[54] WHIRLEY BALLS AMUSEMENT DEVICE

[76] Inventor: Dov Shazeer, 1425 Magee Ave., Philadelphia, Pa. 19111

[21] Appl. No.: 406,811

[22] Filed: Aug. 10, 1982

[51] Int. Cl.[3] ..... A63F 7/00

[52] U.S. Cl. ..... 273/109

[58] Field of Search ..... 273/109, 110, 113, 115, 273/116

[56] References Cited

U.S. PATENT DOCUMENTS

| | | | |
|---|---|---|---|
| 450,653 | 4/1891 | Wheeler | 273/115 |
| 649,481 | 5/1900 | Roscher | 273/109 |
| 733,886 | 7/1903 | Wallace . | |
| 799,985 | 9/1905 | Howland . | |
| 887,590 | 5/1908 | Cohrs | 273/115 |
| 968,366 | 8/1910 | Krug | 273/88 |
| 1,352,517 | 9/1920 | King . | |
| 2,969,237 | 1/1961 | Rogers . | |
| 3,317,209 | 5/1967 | Dixon | 273/109 |
| 3,502,335 | 4/1970 | Sholin | 273/109 |
| 3,617,061 | 11/1971 | Goldfarb | 273/110 |

FOREIGN PATENT DOCUMENTS

| | | | |
|---|---|---|---|
| 503 | 1/1896 | United Kingdom | 273/115 |

*Primary Examiner*—Richard C. Pinkham
*Assistant Examiner*—Scott L. Brown
*Attorney, Agent, or Firm*—Seidel, Gonda & Goldhammer

[57] ABSTRACT

A hand held housing can be manipulated to cause a pair of balls to move in opposite directions along a groove in the housing. The groove has upstanding inner and outer walls. These walls have a rough surface and the balls have a snug fit in the groove.

10 Claims, 3 Drawing Figures

FIG. 1
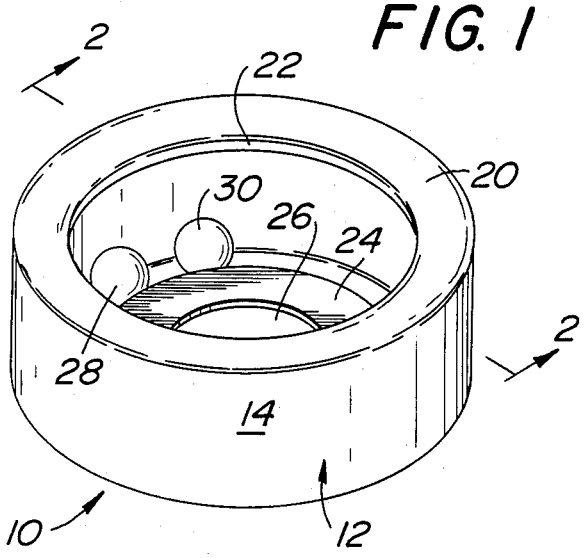
FIG. 2
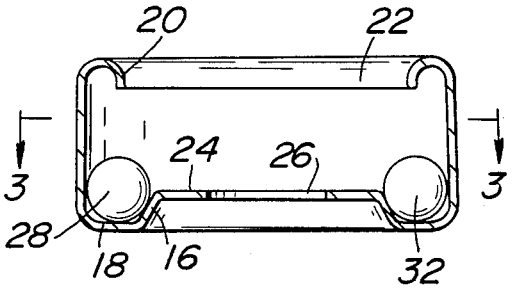
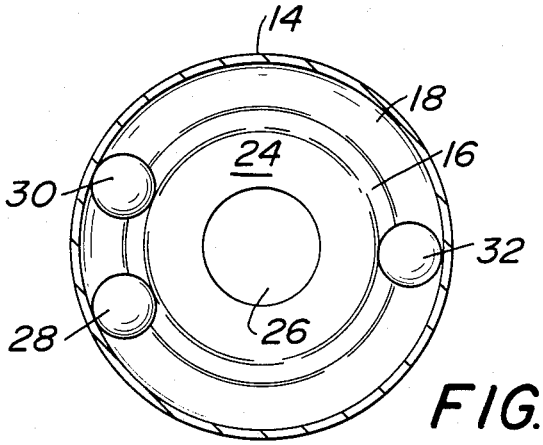
FIG. 3

WHIRLEY BALLS AMUSEMENT DEVICE

SUMMARY OF THE INVENTION

The amusement device includes a housing having an open top and a horizontally disposed upwardly facing circular groove in its bottom wall. The outer periphery of the groove is defined by a vertical wall having a height substantially higher than the depth of the groove. The groove is a rough surface with at least two balls of a hard material in the groove. The balls have a snug fit in the groove and contact the surface of the groove. The housing is of a size so that it can be hand held and manipulated to cause the balls to move in opposite directions.

The balls are preferably of the same mass and of different colors. When three balls are disposed within the groove, some skill is needed in order to cause two of the balls to move along the groove while one appears to be stationary.

It is an object of the present invention to provide a novel amusement device comprising a housing having a plurality of balls disposed within a groove and of a size so that it can be hand held and manipulated to cause the balls to move in opposite directions.

It is another object of the present invention to provide a novel amusement device which is simple, inexpensive, and requires skill in manipulation of the components.

Other objects will appear hereinafter.

For the purpose of illustrating the invention, there is shown in the drawings a form which is presently preferred; it being understood, however, that this invention is not limited to the precise arrangements and instrumentalities shown.

DESCRIPTION OF THE DRAWINGS

FIG. 1 is a perspective view of the amusement device of the present invention.

FIG. 2 is a sectional view taken along the line 2—2 in FIG. 1.

FIG. 3 is a sectional view taken along the line 3—3 in FIG. 2.

DETAILED DESCRIPTION OF THE INVENTION

Referring to the drawing in detail, wherein like numerals indicate like elements, there is shown in FIG. 1 an amusement device in accordance with the present invention designated generally as 10. The device 10 includes an annular housing 12 having an outer wall 14 and an inner wall 16. The lower peripheral portion of the wall 14 cooperates with the wall 16 to define an annular groove 18. The height of wall 14 is substantially greater than the height of the groove and is also substantially greater than the height of wall 16. The upper end of wall 14 may be provided with an inwardly directed lip 20 which terminates at an opening 22. The bottom wall 24 is horizontally disposed and therefore perpendicular to the wall 14. Wall 24 may be provided with a centrally disposed opening 26.

The housing 12 is preferably made from a polymeric plastic material which may be transparent or opaque with the groove 18 having a rough surface. Thus, groove 18 should not have a smooth surface as would be present if the housing 18 were made from glass. The housing 12 preferably has a diameter which is at least twice its height. The housing 12 is preferably made in the size so that it may be hand held. The size of the housing 12 may vary from a size adapted for use by a child as compared with a size adapted for use by an adult.

Within the groove 18 there is provided a plurality of balls designated 28, 30 and 32. While three balls are illustrated in the groove 18, the device may have only two balls if desired. When only two balls are provided, skill is required to manipulate the housing 12 so as to cause the balls to move in opposite directions along the groove 18. When three balls are provided, skill is required to cause two of the balls such as balls 28 and 30 to move in opposite directions while causing ball 32 to appear to be stationary. After contacting one another, the balls 28 and 30 are then caused to move in opposite directions toward the ball 32.

The balls 28, 30 and 32 are preferably made in different colors from a hard material such as glass or steel. The balls should not be made from a soft material such as rubber which will deform upon contact. The balls should be of the same mass but need not be of the same size. The wall 14 includes the lip 20 so as to prevent the balls from escaping from the housing due to centrifugal force. The opening defined by lip 20 and the opening 26 facilitate observation of the balls in groove 18.

Thus, it will be noted that the device 10 is simple and the components thereof are few in number whereby the device 10 may be inexpensive. The device 10 may be used with the groove 18 dry or wet. When the groove 18 is wet with water, it is easier to manipulate the balls and cause them to move in different patterns. The balls need not be manipulated so as to move in opposite directions but may be manipulated so as to move in the same direction at the same speed so as to remain the same distance apart.

Besides causing the balls to move in oposite directions, other manipulations are possible. For example, with balls 28 and 30 in the groove 18, you can cause ball 28 to remain stationary while the ball 30 rolls around the groove 18. Ball 30 hits ball 28. Ball 30 becomes stationary while ball 28 rolls around the groove 18. Now ball 28 hits ball 30. Ball 28 becomes stationary again while ball 30 rolls around the groove 18. The process can be repeated endlessly. If the balls 28 and 30 are of different colors, the impression of one whirling ball and one stationary ball which continuously changes colors, is created. The process also illustrates the well-known principle of conservation of momentum in physics (i.e., balls of equal mass which have an elastic collission exchange momentum and kinetic energy).

Like processes can be demonstrated with three balls in the groove 18. The illussion of ball 28 spinning and balls 30, 32 stationary (but changing color) can be created; as well as the illussion of two spinning balls and one stationary ball which changes color. These illussions are likewise explained by the theory of elastic collision in physics.

An explanation as to how one can start twostationary balls rolling in oposite directions is as follows. Hold the housing 12 so that the bottom wall 26 is at an acute angle to the floor (i.e., not perpendicular to the floor). The two balls will naturally roll to the lowest point in the housing 12 i.e., the part of the groove 18 which is closest to the floor. Now with a jerking motion, move the whole housing 12 horizontally in the direction away from the upper end of the groove 18.

The inertia of the balls will cause the balls to move apart. As the balls move apart, straighten the housing 12 so that the bottom wall is parallel to the floor. When the balls hit each other at the opposite end of the groove 18, they will bounce back. At that point in time, assist the return movement of the balls by jerking the housing in the opposite direction. Synchronize the jerking motions with the collission of the balls.

The present invention may be embodied in other specific forms without departing from the spirit or essential attributes thereof and, accordingly, reference should be made to the appended claims, rather than to the foregoing specification, as indicating the scope of the invention.

I claim:

1. An amusement device comprising a plastic cylindrical housing having a horizontally disposed upwardly facing circular groove in its bottom wall, said groove being defined on its outer periphery by a vertical wall substantially higher than the depth of the groove, said groove being defined by a rough surface on inner and outer walls of said groove, at least two marble balls in said groove, said balls being of the same mass and having different colors, said balls having a snug fit in said groove and substantially simultaneously contacting said surface of both said walls, said housing being of a size so that it can be hand-held and manipulated to cause the balls to move in opposite directions, and said inner wall having a sufficient height to prevent movement of the balls radially inwardly during normal use.

2. A device in accordance with claim 1 wherein said housing has an inwardly extending lip at the upper end of said vertical wall.

3. A device in accordance with claim 1 wherein said bottom wall has its periphery connected to the upper end of the inner periphery of said groove and has a centrally disposed hole coaxial with the upper end of said housing.

4. A device for demonstrating the principal of conservation of momentum comprising a housing having an open top and a horizontally disposed upwardly facing circular groove, said groove being defined on its outer periphery by a vertical wall substantially higher than the depth of the groove, said groove defined by a rough surface on inner and outer walls of said groove, at least two balls of hard material in said groove, said balls being of equal mass, said balls having snug fit in said groove and substantially simultaneously contacting said rough surface on both the inner and outer walls of said groove, said housing being of a size so that it can be hand-held and manipulated to cause the balls to move in opposite directions in said groove and contact one another, and said inner wall having a sufficient height to prevent movement of the balls radially inwardly during normal use.

5. A device in accordance with claim 4 wherein said housing has an inwardly extending lip at the upper end of said vertical wall.

6. A device in accordance with claim 4 wherein the housing has a bottom wall containing a centrally disposed hole therein coaxial with the upper end of said housing.

7. A device in accordance with claim 4 wherein said balls are made of glass.

8. A device in accordance with claim 4 wherein said balls are made of steel.

9. A device in accordance with claim 4 wherein the elevation of the upper end of the inner wall of the groove is approximately at the center of the balls.

10. A device in accordance with claim 9 wherein said balls are of different colors.

* * * * *